US005382872A

United States Patent [19]

Kim et al.

[11] Patent Number: 5,382,872

[45] Date of Patent: Jan. 17, 1995

[54] ELECTRON GUN FOR A COLOR CATHODE RAY TUBE

[75] Inventors: Kyung-Nam Kim; Seong-Woo Lee; Jae-Yul Hwang; Jong-Kwan Kim, all of Kyungki, Rep. of Korea

[73] Assignee: Samsung Electron Devices Co., Ltd., Kyungki, Rep. of Korea

[21] Appl. No.: 944,971

[22] Filed: Sep. 15, 1992

[30] Foreign Application Priority Data

Dec. 18, 1991 [KR] Rep. of Korea ..... 91-23390

[51] Int. Cl.[6] ..... H01J 29/50

[52] U.S. Cl. ..... 313/414; 313/449; 313/460

[58] Field of Search ..... 313/414, 449, 460, 412

[56] References Cited

U.S. PATENT DOCUMENTS

| | | | |
|---|---|---|---|
| 4,370,592 | 1/1983 | Hughes et al. | 313/414 |
| 4,388,552 | 6/1983 | Greninger | 313/414 |
| 4,764,704 | 8/1988 | New et al. | 313/449 X |
| 5,013,963 | 5/1991 | Ikegami et al. | 313/414 |
| 5,262,702 | 11/1993 | Shimoma et al. | 313/414 X |

*Primary Examiner*—Donald J. Yusko
*Assistant Examiner*—Ashok Patel
*Attorney, Agent, or Firm*—Leydig, Voit & Mayer

[57] ABSTRACT

An electron gun for a color cathode ray tube includes a last accelerating electrode having a large-caliber electron beam passing hole for commonly passing red, blue, and green electron beams. Both ends of the beam passing hole include circular arc portions formed with a predetermined curvature. The center portions where the green electron beam passes through protrude by a predetermined width. The length of the protrusion in the horizontal direction satisfies the following inequality: $L<H-2R(1+\cos\alpha)$, where H designates the horizontal width of the large-caliber electron beam passing hole, R is the radius of the circular arc portions and $\alpha$ is the angle between a line drawn from either center of the circular arc portions to an adjacent apex of the protrusions and a line connecting centers of both circular arc portions. By using the above-described device, the halo of an electron beam landing on a phosphor layer can be decreased, thereby enhancing the resolution of a cathode ray tube adopting the electron gun.

10 Claims, 5 Drawing Sheets

ELECTRON GUN FOR A COLOR CATHODE RAY TUBE

BACKGROUND OF THE INVENTION

The present invention relates to an electron gun for a color cathode ray tube, wherein the last accelerating electrode forming a major lens is improved.

Generally, a cathode ray tube has a panel and a funnel which form a vacuum envelope. Red, green, and yellow phosphors are formed on the inner surface of the panel as stripes or dots, and a shadow mask frame assembly is installed inside the envelope. Also, a cylindrical neck is provided at the rear end of the funnel, so that an electron gun is stored within the neck, and a deflection yoke for deflecting electron beams emitted from the electron gun is mounted on the external surface of the funnel.

In the cathode ray tube constructed as above, electron beams of the red, green, and blue signals from the electron gun in the neck are passed through the shadow mask, thereby selectively landing on the phosphor layer. The quality of the picture formed by the landed electron beams is controlled by the size and shape of the focused electron beam spot and the converging accuracy of the three electron beams.

FIG. 1 is a schematic view of an electron gun described in U.S. Pat. Ser. No. 4,370,592 which is provided for improving the focus and convergence characteristics.

In the electron gun, cathodes 2, a control electrode 3, and a screen electrode 4 are provided constituting a triode for producing electron beams. A focus electrode 5 and an accelerating electrode 6 constitute a major lens system for the accelerating, focusing, and converging of the produced electron beams. The foregoing items are arranged sequentially with respect to the traveling direction of the electron beams. Focus electrode 5 has cup-shaped, first and second members 5*a* and 5*b* on the outgoing side of the electron beams facing accelerating electrode 6, and a third member 5*c* which aces screen electrode 4 located on the incoming side of the electron beams. Accelerating electrode 6 has cup-shaped, first and second members 6*a* and 6*b* on the incoming side of the electron beams.

First member 5*a* of focus electrode 5 and first member 6*a* of accelerating electrode 6 face each other in close proximity having horizontally elongated and common, large-caliber electron beam passing holes 5H and 6H, respectively. Second member 5*b* of focus electrode 5 has individual, small-caliber electron beam passing holes 5R, 5G, and 5B, and second member 6b of accelerating electrode 6 has individual, small-caliber electron beam passing holes 6R, 6G, and 6B.

Supplying respective voltages having a predetermined potential difference across focus electrode 5 and accelerating electrode 6 structured as above, forms an electrostatic lens for controlling the electron beams. However, since both large-caliber electron beam passing holes 5H and 6H have differing vertical and horizontal lines of symmetry, the electromagnetic fields focusing the outer electron beams become distorted, which results in unequal vertical and horizontal focusing effects on the electron beams as they pass through the common beam passing holes. Accordingly, the focusing characteristic of the electron beams is degraded due to the asymmetry of the electrostatic lens, so that the shape of an electron beam spot displayed on the screen is abnormally distorted.

Improvements for solving the above-described problems have been suggested in U.S. Pat. Nos. 4,370,592 and 4,388,552. Referring to FIG. 2, the shape of this electron gun is similar to the electron gun shown in FIG. 1, wherein an accelerating electrode 6 is formed by a first member 61 having a common large-caliber electron beam passing hole 6H and a second member 62 having individual electron beam passing holes 6R, 6G, and 6B.

Common electron beam passing hole 6H of first member 61 is somewhat peanut-shaped, wherein circular arc portions 6S and 6S' which are portions of virtual circles 6V and 6V', respectively, of a predetermined diameter or vertical width W2, are provided at both ends corresponding to outer electron beam passing holes 6R and 6B of second member 62, to protrusions 7 whose linear edges oppose to each other by an interval of a vertical width W1 which is smaller than the diameter (vertical width W2) of circular arc portions 6S, are arranged parallel to each other in the center of first member 61.

In accelerating electrode 6 having large-caliber electron beam passing hole 6H, apices 6*a* are formed at the points where circular portions 6S and 6S' at both ends of large-caliber electron beam passing hole 6H meet with protrusions 7. Thus, a length L along the fiat portions of protrusions 7 can be expressed by the following equation:

$$L=H-2R(1+\cos\alpha)$$

where the horizontal width of common electron beam passing hole 6H is designated by "H," the radius of each circular portion is "R," and the acute angle between a radius drawn from the center of either circular arc portion 6S or 6S' to an adjacent apex, and a horizontal line X–X', is "$\alpha$."

The apex is sharp, and thus functions as a lightning rod by absorbing electric particles, so that the surrounding electric field distribution is abnormally distorted. Such distortion of the electric field distribution occurs within the region through which the electron beams pass. This is because the apex is adjacent to the electron beam passing region. Therefore, as illustrated in FIG. 2, the outer electron beams 81 and 83 (red and blue signals) passing through the outer electrostatic lens formed between focus electrode 5 and accelerating electrode 6 are attracted toward the sharp apices on which the electric field is concentrated, so that the sections of the electron beams become distorted into a triangular shape. When the electron beams having passed through the electrostatic lens are deflected toward the peripheries of the screen due to the deflection yoke, the electron beams are under the influence of severe astigmatism, and are thus distorted as shown in FIG. 3. At the left side of the screen, the spot of electron beam 83 (the blue signal) horizontally extends more severely than that of the red signal. Conversely, the spot of electron beam 81 of the red signal horizontally extends more severly than that of the blue signal at the right side of the screen. The difference in each signal electron beam spot degrades the color purity of the picture.

SUMMARY OF THE INVENTION

The present invention is submitted to solve the above-described problem. Accordingly, it is the object of the present invention to provide an electron gun for a cathode ray tube, which can realize a picture of good quality by suppressing the distortion of electron beams due to one common large-caliber lens.

To achieve the above and other objects of the present invention, there is provided an electron gun for a color cathode ray tube including a triode which has three in-line cathodes to generate one central electron beam and two outer electron beams at its sides, control and screen electrodes each having three in-line electron beam passing holes; and a major lens having a focus lens and an accelerating electrode, for focusing and accelerating the three electron beams, wherein the accelerating electrode comprises:

a peanut-shaped first member having a common electron beam passing hole for allowing the three electron beams to be commonly passed therethrough, which is formed of two outer circular are portions surrounding outer portions of both outer electron beams passing regions, and two protrusions positioned between two outer circular arc portions and, extending toward the advancing axis of the central electron beam along a predetermined length and opposing each other while straddling the central electron beam passing region; and a second member having individual electron beam passing holes through which the three electron beams respectively pass, whereby the length L of either protrusion in the horizontal direction satisfies the following inequality:

$$L<H-2R(1+\cos\alpha)$$

where H designates the horizontal width of the large-caliber electron beam passing hole, R is the radius of the circular portion, and $\alpha$ is the angle formed between a line drawn from either center of the circular arc portions to an adjacent apex of the protrusions and a line connecting centers of both circular arc portions.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
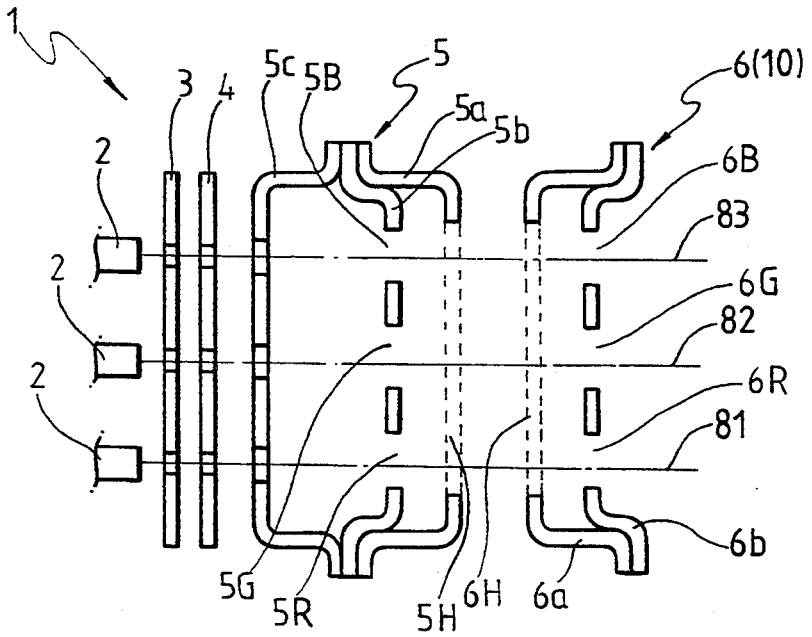
FIG. 1(PRIOR ART)
FIG. 1 is all elevational section view of a general conventional electron gun for a color cathode ray tube.
Figure 2:
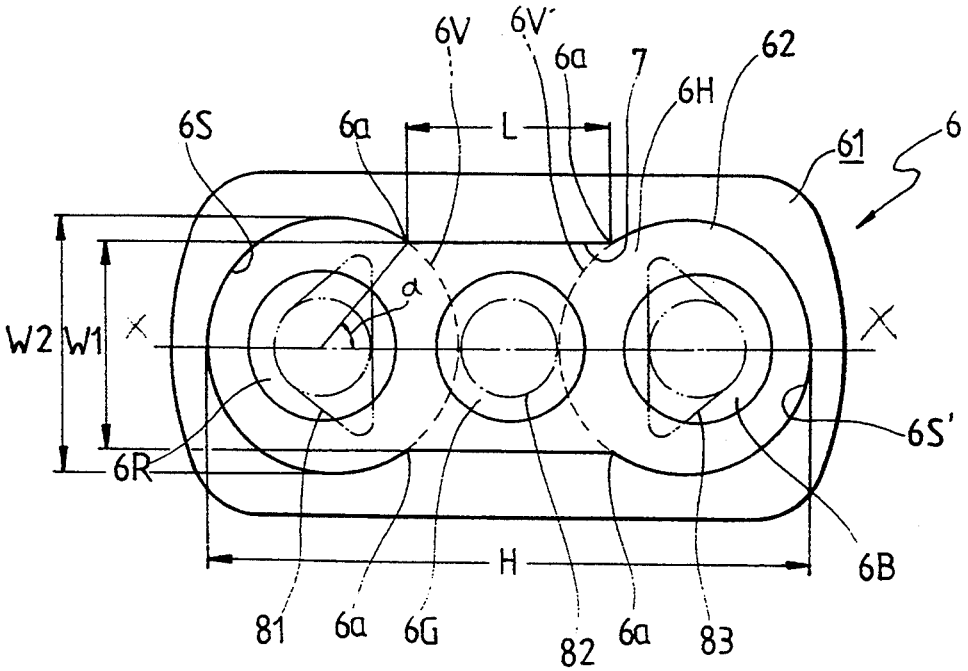
FIG. 2(PRIOR ART)
FIG. 2 is a frontal view of all accelerating electrode of another conventional electron gun for a color cathode ray tube.
Figure 3:
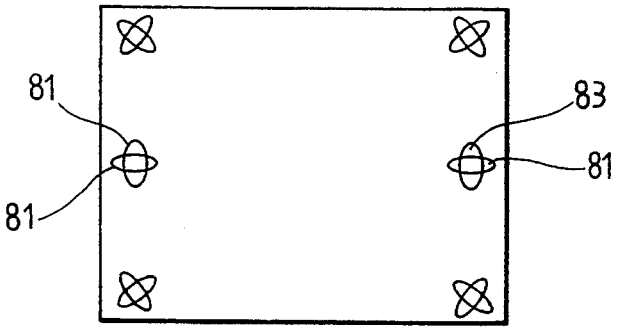
FIG. 3(PRIOR ART)
FIG. 3 shows beam spot formation on a screen, resulting from the electron gun for the conventional color cathode ray tube of FIG. 2.

An in-line type electron gun 1 for a color cathode ray tube according to the present invention includes cathodes 2, a control electrode 3, and a screen electrode 4 which together form a triode, a focus electrode 5 which forms a major lens system as the electron gun for the conventional color cathode ray tube shown in FIG. 1. Such an electron gun further includes a last accelerating electrode 10 as shown in FIGS. 4A, 4B, or 4C.

Figure 4A:
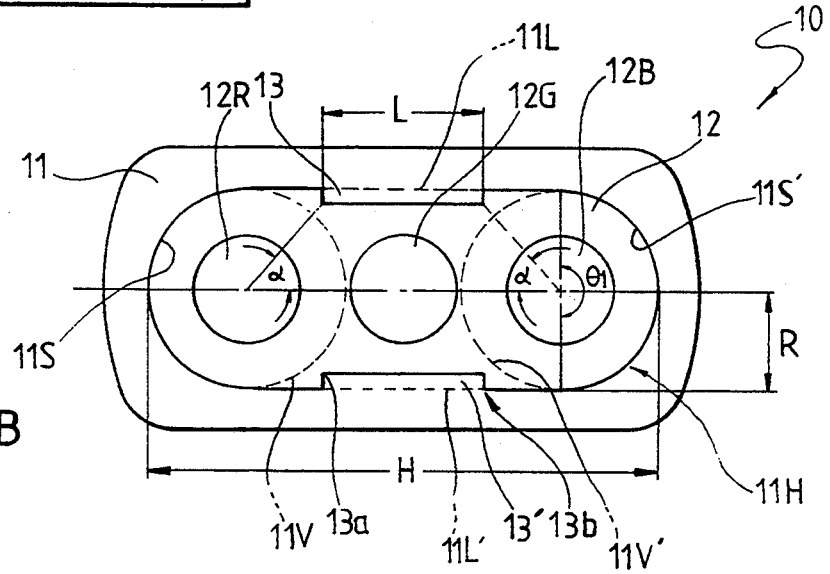
FIG. 4A is the frontal view of an embodiment of an accelerating electrode of all electron gun for a color cathode ray tube according to the present invention.
Figure 4B:
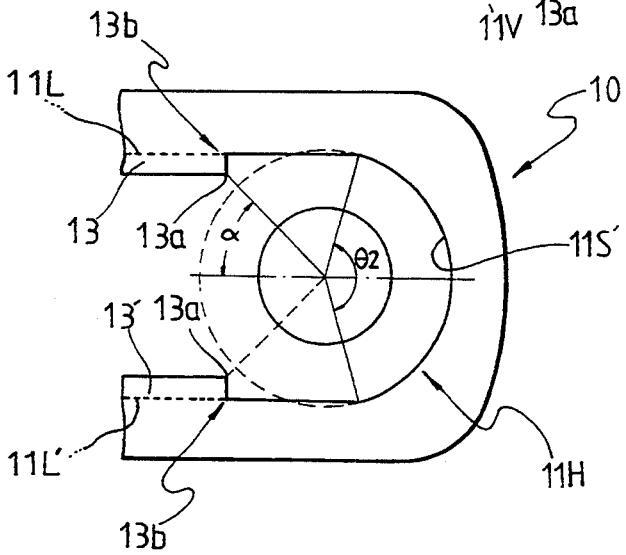
FIG. 4B is the frontal view of another embodiment of all accelerating electrode of the electron gun for the color cathode ray tube according to the present invention.
Figure 4C:
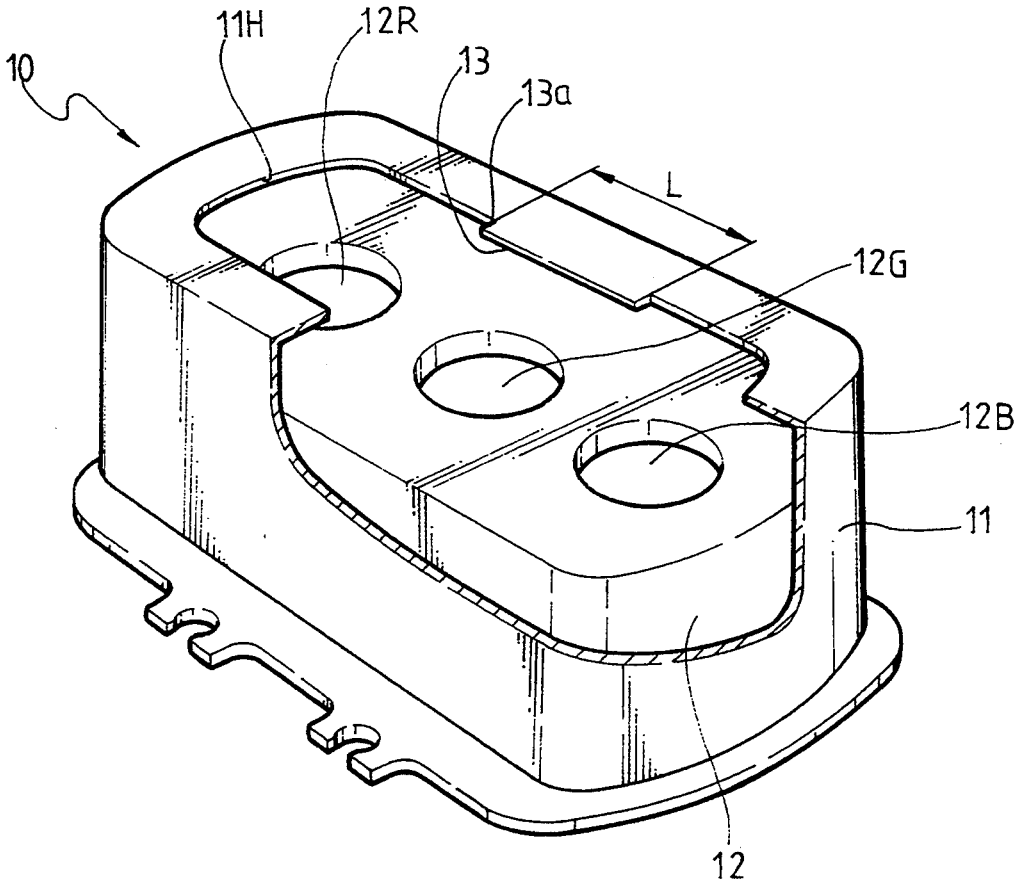
FIG. 4C is a perspective view showing a partially cutaway accelerating electrode of an electron gun for a color cathode ray tube according to the present invention.

Referring to FIGS. 4A and 4C, accelerating electrode 10 comprises a first cup-shaped member 11 having a large-caliber electron beam passing hole 11H formed in the shape of an elongated slot having circular arc portions 11S and 11S' and a recessed neck portion which has a vertical width that is less than twice the radius of the circular arc portions 11S and 11S'. A second cup-shaped member 12 having three individual electron beam passing holes 12R, 12G, and 12B is spaced apart from large-caliber electron beam passing hole 11H of first cup-shaped member 11 by a predetermined distance. Large-caliber electron beam passing hole 11H horizontally extends enough to pass all three electron beams which advance in the same horizontal plane. Here, circular arc portions 11S and 11S' each have a predetermined and are provided at both ends of linear edges 11L and 11L' parallel to each other at a predetermined interval, while protrusions 13 and 13' extend toward the center of central electron beam passing hole 12G. The length L of each protrusion is defined by the following inequality in accordance with the characteristic of the present invention:

$$L<H-2R(1+\cos\alpha)$$

where "H" designates the horizontal width of large-caliber electron beam passing hole 11H; "R" is the radius of either circular arc portion: and "$\alpha$" is the acute angle between a radius drawn from the center of either circular arc portion to an adjacent apex **13*a* of protrusion 13 or 13'**, and a horizontal line X–X' which passes through the centers of the individual electron beam passing holes.

The above inequality indicates that apices **13*a* at both ends of protrusions 13 are positioned outside virtual circles 11V and 11V' which establish the circular arc portions 11S. Preferably, stepped connecting portions 13*b*** are favorable for the manufacturing process.

Also, preferably, the sizes of circular arc portions 11S and 11S' at both sides of large-caliber electron beam passing hole 11H are determined to be less than half of the virtual circle. That is, the central angle $\theta 1$ of circular arc portion 11S' can be determined as 180° as shown in FIG. 4A. Otherwise, the central angle $\theta 2$ can be determined to be below 180°, as shown in FIG. 4B.

The operation of the electron gun of the color cathode ray tube according to the present invention constructed as the above is described below.

Upon supplying predetermined voltages to each electrode, a prefocus lens is formed between screen electrode 4 and focus electrode 5, and a major lens is formed between focus electrode 5 and accelerating electrode 10. Therefore, the electron beams produced ill the triode are pre-focused and accelerated in the prefocus lens, and finally focused and accelerated in the major lens, thereby landing on the phosphor screen of a cathode ray tube. By limiting length L of protrusions 13 and 13' of large-caliber electron beam passing hole 11H in accelerating electrode 10, each apex 13*a* becomes positioned outside the normal trajectory of circular arc portions 11S or 11S'.

As described above, since the apex is placed outside the circular arc portion's trajectory, the electric field concentration around the region where the electron beams are passed is lessened, and the electric field concentrated on the apex located outside this region only slightly affects the electron beams passing within the trajectory of the circular arc portion. In other words, apices 13*a* of protrusions 13 and 13' are positioned outside the area of the virtual circle of both circular arc positions, so that the influence of the protrusion on the electron beams passing within the virtual circle is weak.

Figure 5:
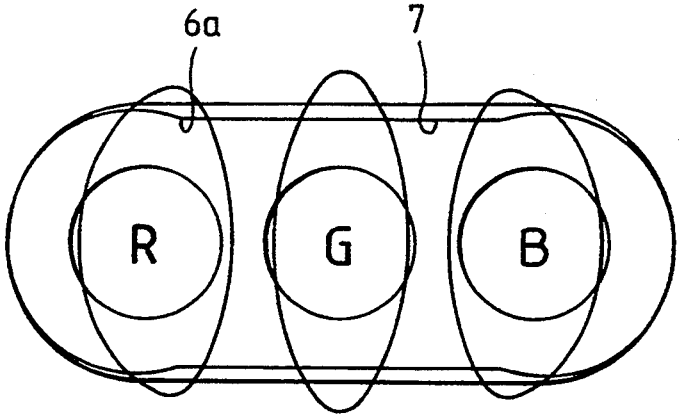
FIG.5(PRIOR ART)
FIG. 5 is a computer-simulated view showing the state of controlled electron beams in a conventional electron gun.
Figure 6:
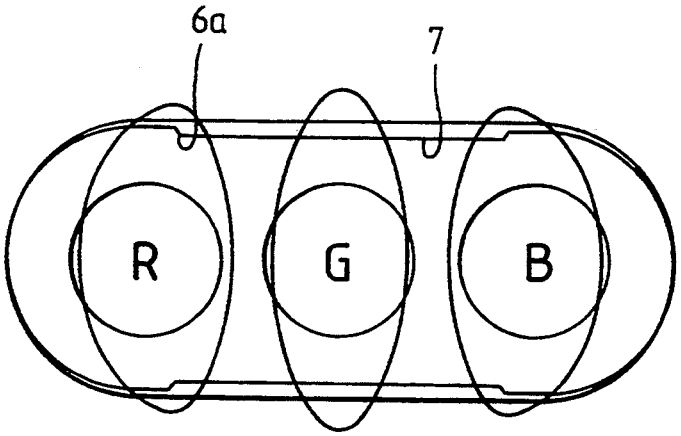
FIG.6(PRIOR ART)
FIG. 6 is a computer-simulated view showing the state of controlled electron beams in another conventional electron gun.
Figure 7:
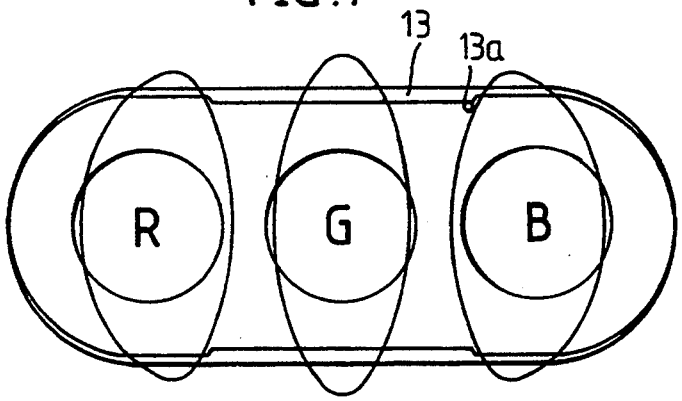
FIGS. 7, 8 and 9 are computer-simulated views showing respective states of controlled electron beams in the embodiments of the electron gun according to the present invention.
Figure 8:
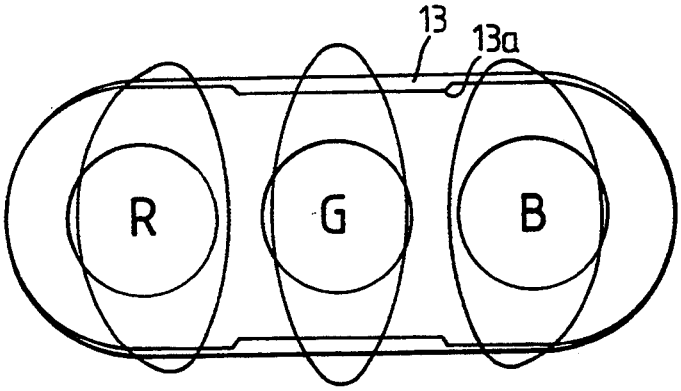
Figure 9:
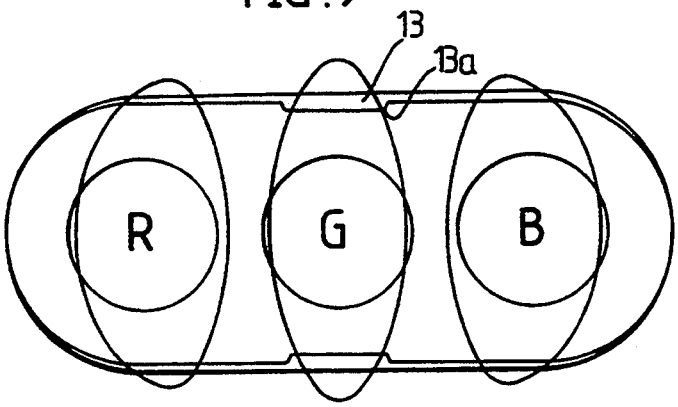

FIG. 5 through 9 illustrate respective states of electron beams controlled by main lenses in the above-described conventional and present electron guns. Here, FIG. 5 represents a controlled electron beam state in the main lens of the so-called COTY electron gun shown in FIG. 1. FIG. 6 represents a controlled electron beam state in the main lens of an electron gun whose construction is similar to that shown in FIG. 5. Also, FIGS. 7, 8 and 9 represent controlled electron beam states in the main lenses of the electron gun according to the present invention.

In the conventional electron beams, as shown in FIGS. 5 and 6, each apex of protrusions 7 advances into the outer electron beam passing regions, which in turn distorts electron beams R and B. However, in the embodiments of the electron gun according to the present invention, the lengths of protrusions 13*a* are different from one another, as shown in FIGS. 7, 8 and 9. Here, each apex of protrusions 13*a* is kept away from the outer electron beam passing hole, and thus the outer electron beams are not distorted, unlike the conventional electron gun.

In the electron gun for the color cathode ray tube according to the present invention as described above, the length of the protrusion at the center of the large-caliber electron beam passing hole of the last accelerating electrode is adjusted. As a result, the halo of the electron beam landing on the phosphor screen can be prevented, and the focusing characteristic is enhanced, thereby improving resolution of a cathode ray tube which adopts the electron gun of the present invention.

What is claimed is:

1. An electron gun comprising:

a triode having a plurality of in-line cathodes to generate a plurality of electron beams, and including control and screen electrodes each having a plurality of in-line electron beam passing holes; and a major lens having a focus electrode and an accelerating electrode for focusing and accelerating the plurality of electron beams, the accelerating electrode including a first member having first, second and third electron beam passing holes aligned along an axis, a second member spaced apart from said first member having an elongated electron beam passing hole which comprises first and second opposing circular arc portions, a neck portion disposed between the first and second circular arc portions and first and second connecting members which are connected to the neck portion at first and second apices, respectively, the distance between the first and second apices satisfying the following inequality:

$$L<H-2R(1+\cos\alpha)$$

where H represents a horizontal dimension of the elongated electron beam passing hole measured along a central axis which passes through the center of the first and second circular arc portions, R represents the radius of the first circular arc portion and $\alpha$ represents an angle formed between the central axis and a line which interconnects the center of the first circular arc portion with the first apex.

2. An electron gun for a color cathode ray tube as claimed in claim 1 wherein said first and second connecting members include steps.

3. An electron gun for a color cathode ray tube as claimed in claim 1 wherein the angle subtended by said first circular arc portion is less than 180°.

4. An electron gun for a color cathode ray tube as claimed in claim 3, wherein the first connecting member which connects the first circular portion and the first apex includes a step.

5. An accelerating electrode for a color cathode ray tube comprising:

a first member having first, second and third electron beam passing holes aligned along a central axis;

a second member spaced apart from said first member having an elongated electron beam passing hole which comprises first and second opposing circular arc portions and a neck portion disposed between the first and second opposing circular arc portions; and first and second connecting members which are connected to the neck portion at first and second apices which are positioned at a distance from the center of the first and second circular arc portions, respectively, which is greater than a radius of the first and second circular arc portions.

6. An accelerating electrode as claimed in claim 5 wherein the first and second circular arc portions subtend a central angle which is less than 180°.

7. An accelerating electrode as claimed in claim 5 wherein said first and second connecting members are formed in the shape of a step to connect the neck portion with the first and second circular arc members.

8. An accelerating electrode for a color cathode ray tube comprising:

a first member having first, second and third electron beam passing holes aligned along an axis;

a second member spaced apart from said first member having an elongated electron beam passing hole which comprises first and second opposing circular arc portions and a neck portion disposed between the first and second opposing circular arc portions;

first and second connecting members which are connected to the neck portion at first and second apices, respectively, the neck portion having a horizontal dimension parallel to a central axis that passes through the centers of the first and second circular arc portions, the horizontal dimension satisfying the following inequality:

$$L<H-2R(1+\cos\alpha)$$

where H represents a horizontal dimension of the elongated electron beam passing hole measured along the central axis from the first circular arc portion to the second circular arc portion, R represents the radius of the circular arc portion and $\alpha$ represents an angle formed between the central axis and a line which interconnects the center of the first circular arc portion with the first apex.

9. An accelerating electrode as claimed in claim 8 wherein the first and second circular arc portions subtend a central angle which is less than 180°.

10. An accelerating electrode as claimed in claim 8 wherein said first and second connecting members are formed in the shape of a step to connect the neck portion with the first and second circular arc members.

* * * * *